US007291056B2

(12) United States Patent
Ohishi et al.

(10) Patent No.: US 7,291,056 B2
(45) Date of Patent: Nov. 6, 2007

(54) METHOD AND SYSTEM FOR CLEANING GLASS SURFACE OF PAVEMENT LIGHT OR REFLECTOR

(75) Inventors: Naoyuki Ohishi, Yokohama (JP); Hisaaki Kawaguchi, Yachimata (JP)

(73) Assignee: Sanki Engineering Co., Ltd., Tokyo (JP)

( * ) Notice: Subject to any disclaimer, the term of this patent is extended or adjusted under 35 U.S.C. 154(b) by 0 days.

(21) Appl. No.: 10/573,630

(22) PCT Filed: Aug. 5, 2004

(86) PCT No.: PCT/JP2004/011248

§ 371 (c)(1),
(2), (4) Date: Mar. 28, 2006

(87) PCT Pub. No.: WO2005/047606

PCT Pub. Date: May 26, 2005

(65) Prior Publication Data

US 2007/0037484 A1 Feb. 15, 2007

(30) Foreign Application Priority Data

Nov. 13, 2003 (JP) ..... 2003-383348

(51) Int. Cl.
*B24B 49/00* (2006.01)

(52) U.S. Cl. ..... 451/5; 451/8; 451/92

(58) Field of Classification Search ..... 451/5, 451/6, 8–11, 59, 75, 92
See application file for complete search history.

(56) References Cited

U.S. PATENT DOCUMENTS 6,104,980 A 8/2000 Sato et al.

FOREIGN PATENT DOCUMENTS

JP 1193127 8/1989

(Continued)

OTHER PUBLICATIONS

Sangyo Kikai, "Low-Pollution Bicarbonate Blast Apparatus", Aug. 2001, pp. 60-62. New Technologies Topic.

*Primary Examiner*—Dung Van Nguyen
(74) *Attorney, Agent, or Firm*—Michael J. Striker

(57) ABSTRACT

A method and a system for cleaning the glass surface of an object, such as a surface light, a run way guide light, or a reflector, installed on various pavements or roads, by propelling a cleaning agent from a blast nozzle to the glass surface. The blast nozzle is installed on the front end of an arm of a working robot mounted on a truck. A truck mounted with a cleaning agent blaster and a working robot (21) provided with a blast nozzle (23) and a CCD camera (24) at the forward end of a manipulator is stopped at a specified position in the vicinity of an object to be cleaned, i.e. surface light or a reflection mirror (30). Based on an image of the object taken by the CCD camera (24), dimensions are recognized from distance information through processing by a vehicle-mounted computer, the image shape of the object is collated with a stored shape and recognized, and then positional information of the recognized object is searched. Cleaning agent is propelled from the blast nozzle (23) at the forward end of the manipulator (22) toward the object while measuring the extent of cleaning, brightness or light intensity of the cleaned object is determined by the CCD camera, and automatic cleaning is performed.

13 Claims, 4 Drawing Sheets

FOREIGN PATENT DOCUMENTS

| | | | |
|---|---|---|---|
| JP | 7-26525 | | 1/1995 |
| JP | 07331626 | | 12/1995 |
| JP | 10241098 | | 9/1998 |
| JP | 2004-183208 | * | 7/2004 |

* cited by examiner

METHOD AND SYSTEM FOR CLEANING GLASS SURFACE OF PAVEMENT LIGHT OR REFLECTOR

BACKGROUND OF THE INVENTION

1. Field of the Invention

The present invention relates to a method for cleaning the glass surface of a surface light, a runway guide light, or a reflector by blasting a cleaning agent, and a system for carrying out the method.

2. Prior Art

A surface light, a runway guide light, or a reflector buried or installed on pavement and on road such as a landing strip, a road for tracks, a taxiway or in the vicinity thereof at some distance from each other often cannot perform its predetermined function due to an adhesion of automotive exhaust gas produced by traveling, stopping and starting on a track, adhesion of abrasion dust from tires, debris adhesion of calking compounds for waterproof processing a part of such a surface light, as well as adhesion or fouling of rain water and dust. Although dirt caused by an adhesion of rainwater and dust can be easily removed, it is not easy to completely remove a small dot-like spot from abrasion dust of a tire or calking compound stained (vaporized) onto the glass surface of a surface light.

For cleaning dust stained on the surface of such an object, an option to be applied is, in general, to sand blast for cleaning rust or polishing a surface of the works in a painting/plating shop. Alternatively, soft blast is used when an object is fragile. As an abrasive (cleaning agent, polishing agent) in a soft blast system, either bicarbonate (sodium bicarbonate) or dry ice (carbon dioxide) is used depending on the object and its purpose (Non-patent document 1). Namely, bicarbonate is used for pharmaceuticals and food additives and it is innocuous to the human body if it is blasted and diffused. Furthermore, dry ice used in this field is prepared by collecting and purifying carbonate dioxide discharged from a factory, so that it is noncombustible (digested material), and is sublimed into carbon dioxide to vaporize at ambient temperature. Therefore, it is practically innocuous.

Non-Patent Document 1: *Sangyo Kikai*, "Low-pollution bicarbonate blast apparatus", 2001, August, pp 60-62.

SUMMARY OF THE INVENTION

As previously described, when an object of cleaning is a surface light, a runway guide light, or a reflector, the dust has been conventionally cleaned by hand using a scraper, which is effective but also dangerous if a surface light is cleaned while the traffic continues on the street. On the other hand, if the traffic of the work site is blocked for a long time, it will likely cause traffic congestion. Therefore, development of a system by which a surface light or a reflector can be cleaned in a relatively short amount of time has been desired.

The object of the invention is to provide a system for cleaning the glass surface of a surface light or a reflector easily and quickly in which a working robot is mounted on a truck, in which a blast nozzle installed on the front end of a manipulator is operated to approach an object of cleaning while the location of the cleaned object is detected by a monitor and to apply soft blast.

In order to achieve the afore-mentioned object, the invention of claim 1 claims a method for cleaning a glass surface of a surface light or a reflector comprising steps of:

stopping a truck having a canopy mounted with a cleaning agent blaster, a working robot provided with a blast nozzle and a CCD camera at the front end of a manipulator, and an on-vehicle computer at a specified position in the vicinity of an object to be cleaned, i.e. a surface light, a runway guide light or a reflection mirror; operating the manipulator of the robot from an opening floor part, which is freely open-close, provided in the vicinity of the center or the rear part of a load bed of the truck in accordance with instructions from the on-vehicle computer and lowering the blast nozzle toward the object located under the opening floor part;

recognizing dimensions from positional information through processing by a vehicle-mounted computer based on an image of the object for cleaning taken by the CCD camera, collating the image shape of the object with a stored shape to recognize, and searching positional information of the recognized object accordingly;

and blasting a cleaning agent from the blast nozzle mounted on the front end of the manipulator of the working robot toward the object while measuring and determining the extent of cleaning based on brightness or light intensity of the object for cleaning from an image taken by the CCD camera to perform and complete automatic cleaning.

The invention of claim 2 claims a system for cleaning a glass surface of a surface light or a reflector comprising a truck mounted with a cleaning agent blaster, an articulated working robot including a blast nozzle and a CCD camera mounted on the front end of a manipulator, and an operating unit including an on-vehicle computer operable for recognizing dimensions from positional information based on an image of the cleaned object, i.e. a surface light, a runway guide light, or a reflector taken by the CCD camera and for collating the image shape of the object with a stored shape so as to calculate positional information of the object, wherein an opening floor part which is freely open-close is provided in the vicinity of the center or the rear part of a load bed of the truck for approaching the blast nozzle mounted on the front end of the manipulator toward the cleaned object located on the ground and under the load bed in accordance with instructions from the on-vehicle computer;

and wherein a monitor displaying an image taken by the CCD camera for monitoring a cleaned object and a start/stop button for cleaning operation are provided near the driver's seat;

so that after the blast nozzle is lowered, a cleaning agent is blasted from the blast nozzle mounted on the front end of the manipulator of the working robot toward the target object while measuring and determining the extent of cleaning based on brightness or light intensity of the cleaned object from an image taken by the CCD camera to perform and complete automatic cleaning.

The invention of claim 3 claims a system for cleaning a glass surface of a surface light or a reflector further comprising a driver's aid for directional guidance that is capable of operating a truck to capture an object to be cleaned at a predetermined position from an image taken by a forward looking CCD camera mounted under the truck, capable of moving the forward looking CCD camera while automatically capturing the object image, and capable of instructing driving speed and direction of the truck depending on its operation stage.

The invention of claim 4 claims a system for cleaning a glass surface of a surface light or a reflector further comprising an extensible cornice for preventing dissipation of abrasives provided in such a manner to hang under the periphery of an opening floor part of the load bed of a truck so that the abrasive and its volatilized gas produced after cleaning do not leak outside, wherein the opening floor part is closed and the cornice is folded after cleaning so that the abrasive and its volatilized gas are sealed within an isolated room in a canopy on the load bed of the truck mounted with a working robot.

The invention of claim 5 claims a system for cleaning a glass surface of a surface light or a reflector, wherein driving instruction is given by using an image taken by an approach camera provided at the position where an image beneath an opening floor part can be taken, wherein the image can be used as start-up information for the automatic cleaning system which operates on a manipulator.

The invention of claim 6 claims a system for cleaning a glass surface of a surface light or a reflector defined in any of claims 2-5, wherein transmittancy or luminous intensity of an object is measured after cleaning to determine if re-cleaning is required or cleaning is completed.

The invention of claim 7 claims a system for cleaning a glass surface of a surface light or a reflector defined in any of claims 2-5, wherein transmittancy or luminous intensity of an object is stored when the determination of the completion of the cleaning is made, so that the information is used to manage the light of the object.

EFFECT OF THE INVENTION

As explained above, the present invention comprising steps of stopping a truck mounted with a cleaning agent blaster, a working robot provided with a blast nozzle and a CCD camera at the front end of a manipulator at a specified position in the vicinity of an object to be cleaned, i.e. a surface light or a reflection mirror; recognizing dimensions from positional information through processing by a vehicle-mounted computer based on an image of the object for cleaning taken by the CCD camera, collating and recognizing the image shape of the object with a stored shape; searching positional information of the recognized object accordingly; and blasting a cleaning agent from the blast nozzle mounted on the front end of the manipulator of the working robot toward the object while measuring the extent of cleaning, determining brightness or light intensity of the cleaned object from the data obtained by the CCD camera to perform automatic cleaning. As a result, it can prevent the object from being scratched by the hardness of abrasives, is innocuous to the human body, and environmental loading can be suppressed as it vaporizes at ambient temperature. Furthermore, the energy conservation property can be improved by lowering the injection pressure while an object is cleaned safely, easily, and effectively.

In addition, according to the invention, an opening cover panel (or a slide floor) is provided at the center of the load bed of a truck having a canopy, from which an automatic cleaning system operates a manipulator of a robot so as to move a blast nozzle to an object. With this structure, (1) when the cover body mounted on the load bed of a truck is partitioned and a pneumatic expansion cornice surrounds the slide floor opening, cleaning can be performed without leakage of carbon dioxide produced when dry ice used as a cleaning agent is decomposed. Furthermore, the opening cover panel is closed and the cornice is folded after cleaning, so that carbonate dioxide gas is sealed within the cover body. As a result, absorption treatment for carbon dioxide gas can be processed as the truck moves. In addition, a surrounding body can be formed easily, and the time spent for the whole cleaning process can be reduced. (2) Even when robot output is great, since a manipulator is operated in such a manner to project from the lower part of the load bed (a place where a person cannot enter), it is unnecessary to provide a protection fence. (3) When blast for cleaning, such as bicarbonate, which can be diffused is used, it is unnecessary to close the load bed with the opening cover panel (a slide floor).

BEST MODE FOR CARRYING OUT THE INVENTION

Figure 1:
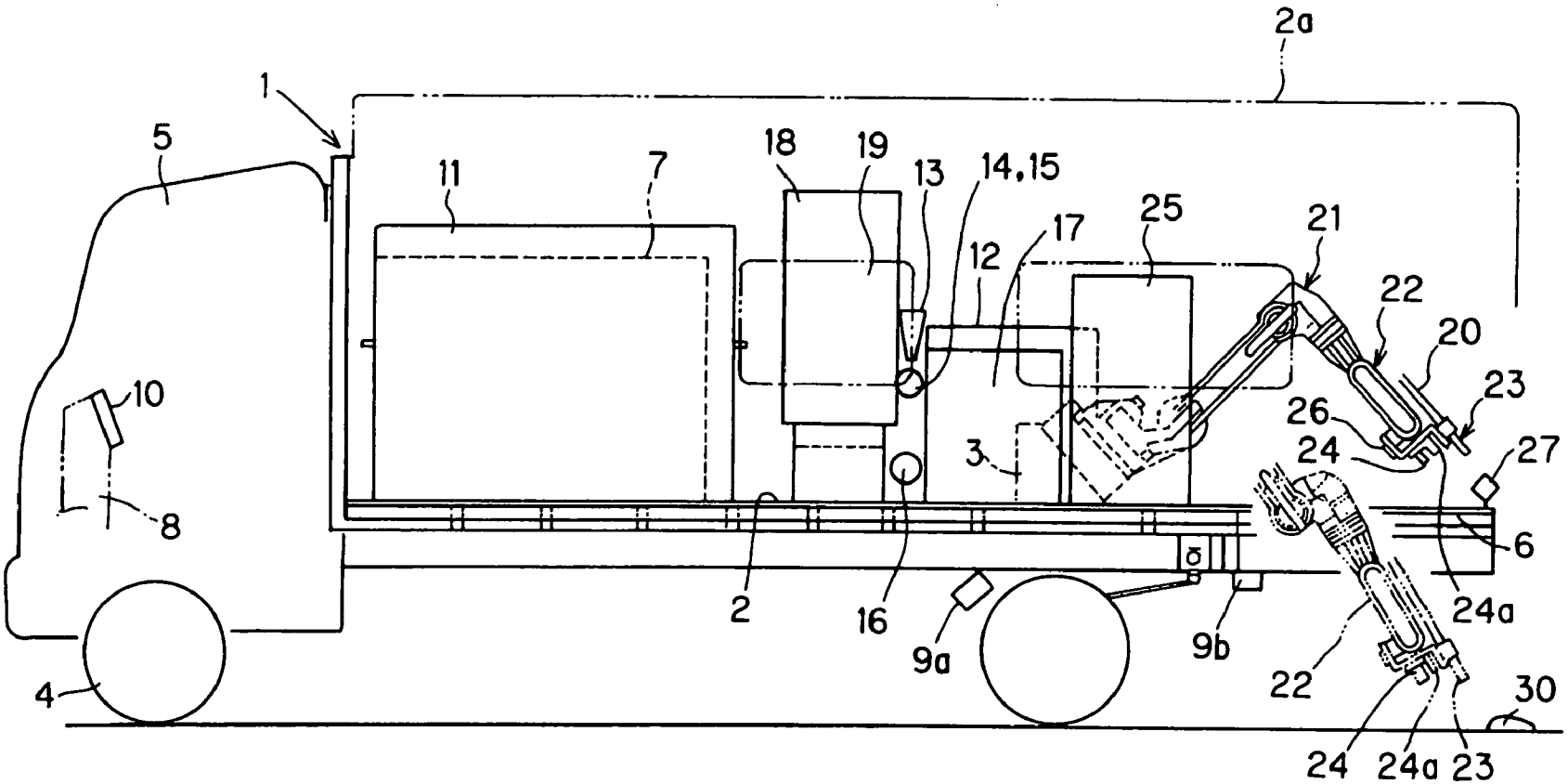
FIG. 1 is a side view of a truck mounted with a cleaning apparatus of the present invention.

A generator 7, a compressor 11, an air dryer 12, a filter 13, a blow tank 14, an air delivery valve 15, an ejector 16, a cleaning agent supply controller 17, a tank of dry ice or bicarbonate that is a cleaning agent (a cleaning agent tank) 18, a cleaning agent quantitative feeder 19, a working robot 21., and a robot controller 25 are mounted on the load bed 2 of a truck 1 having a canopy 2*a*. The working robot 21 shown in the drawings is an articulated robot which is mounted on the slope of a base 3 in an inclined manner. A bracket 26 mounted on a manipulator 22 provided at the front end of an robot arm in such a manner to be mounted with a blast nozzle 23 connected with a high pressure rubber hose 20 derived from the delivery side of the ejector 16, a CCD camera 24 for detecting a cleaned object (surface light, reflector) 30, and a distance sensor 24*a*. Furthermore, an approach camera 27 for confirming whether or not the CCD camera 24 is at the stop position is mounted on the back end of the load bed 2.

A pressure reducer and a pressure detector are arranged along a conduit between a filter 13 and a blow tank 14. A temperature-humidity detector and a compound pressure detector are mounted on a blow tank 14, but not shown in the drawings. A slide floor or a shutter floor 6, which is an opening cover panel, is closed at the same level of the load bed when cleaning is not performed, and is open when cleaning is performed. The closing motion of the slide floor 6 is carried out by expanding a cornice at the level of the load bed floor, or, alternatively, by expanding a sheet curtain (not shown) at the level of the load bed floor.

When dry ice is used as a cleaning agent and dioxide carbonate produced thereafter is processed for absorbing, a slide floor or a shutter floor 6 is closed at the same level of the load bed 2 when not cleaning, and is open when cleaning. In this instance, the inside of a canopy 2*a* is isolated in such a manner to partition the periphery of a movable part of a working robot 21 wherein an absorbing part of a dioxide carbonate absorber is exposed.

Figure 2:
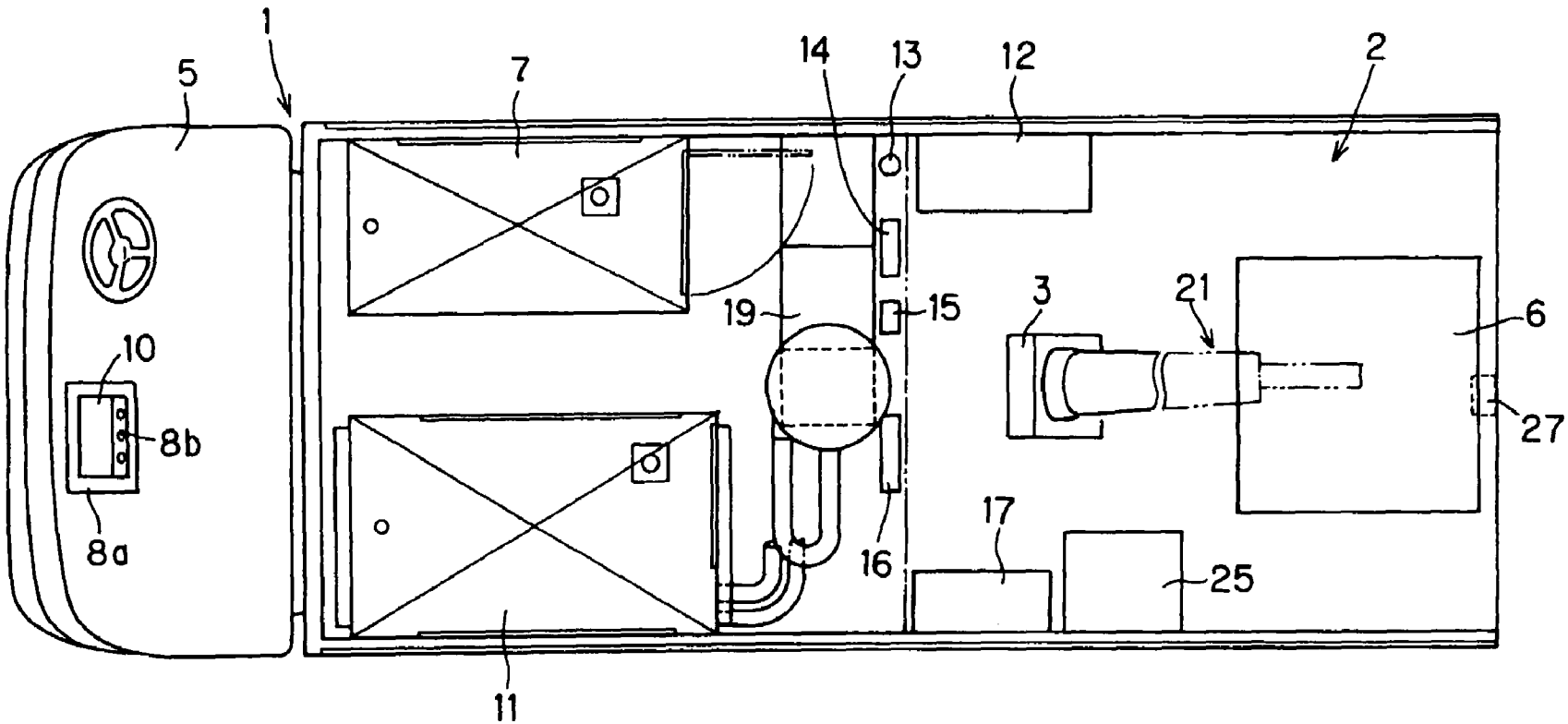
FIG. 2 is a plan view of FIG. 1.
Figure 3:
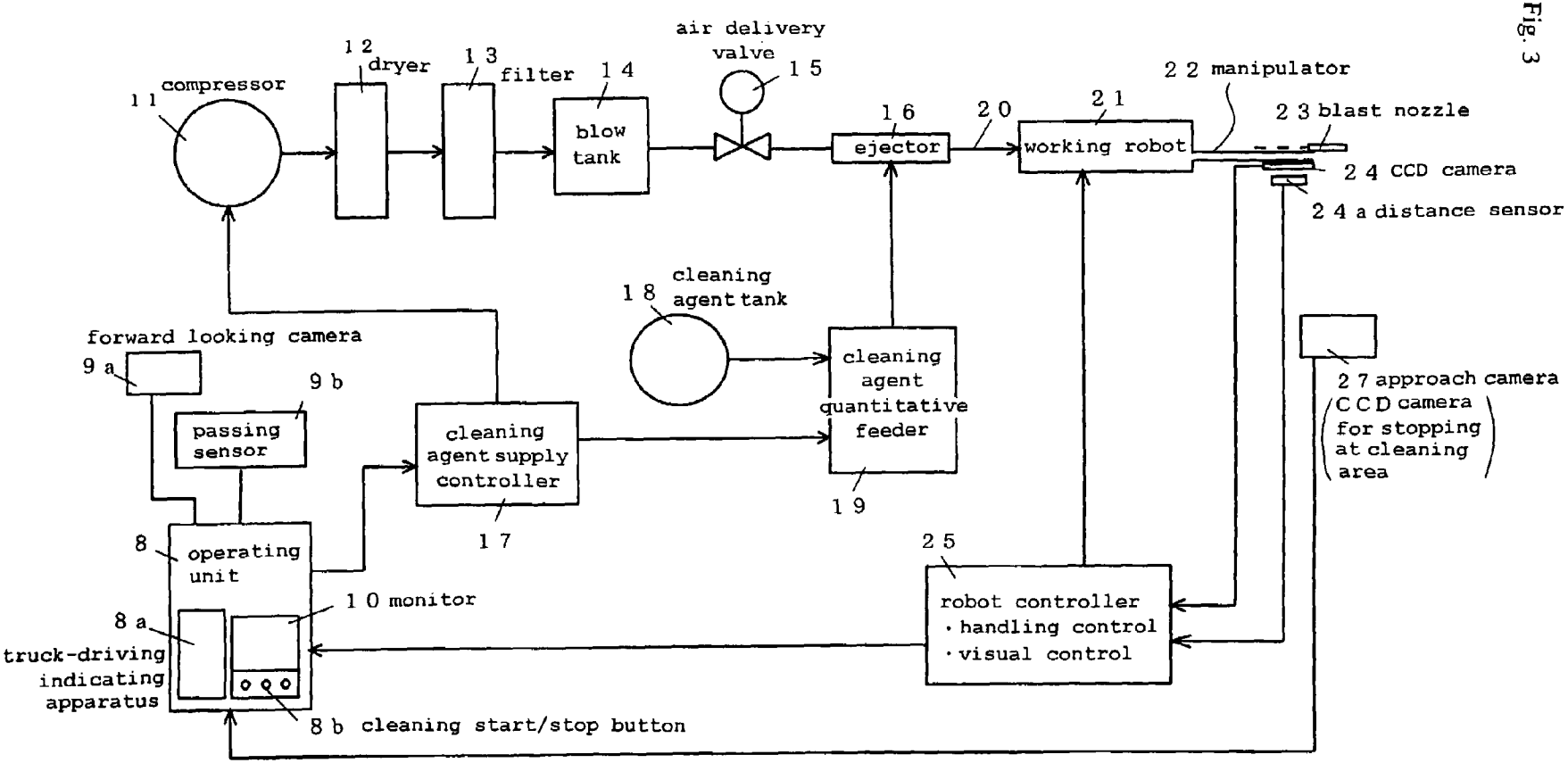
FIG. 3 is a block diagram of a system for cleaning a glass surface.

Furthermore, Reference numeral 4 denotes a wheel, numeral 5 denotes a driver's cab, and numeral 8 denotes an operating unit inclusive on-vehicle computer arranged at an appropriate place in the driver's cab or load bed. Reference numeral 8*a* denotes a truck-driving indicating apparatus, numeral 9*a* denotes a forward looking camera, numeral 9*b* denotes a passing sensor, and numeral 10 denotes a monitor for capturing a cleaned object/automatic confirmation and monitoring of automatic cleaning which comprises an image display for monitoring a cleaned object, and a cleaning start/stop button 8*a* (FIGS. 2 and 3).

While a truck 1 is moving or idling, a slide floor 6 is closed and a working robot 21 stands on a base 3. When blast operation starts, the slide floor 6 is open. According to the Labor Safety and Health Rules, when an output of the robot is 100 W or greater, a safety fence (not shown in a drawing) must be provided and when the robot output is lower than 100 W, such a safety fence is not required. However, because only a manipulator works under the load bed and a person does not enter into the area, it is not necessary to project a fence part downward even though the robot output exceeds 100 W. Although it is not shown in the drawings, a working area (a longitudinal area between an opening part of the slide floor 6 and the ground) can be surrounded by an air pressure expansive cornice so as to prevent a cleaning agent from diffusing and to collect dioxide carbonate gas (by using a gas absorbent).

Although dry ice is normally used as a cleaning agent, powdered bicarbonate can be used depending on the object to be cleaned. When powdered bicarbonate is used, as it easily absorbs moisture, even when a conventional type powder feeder is used to supply a fixed amount of bicarbonate continuously, it tends to produce plenty of lumps. When those lumps are supplied to a blasting apparatus to inject to an object to be cleaned, the lumps clog the injection nozzle, which may cause a problem. In addition, when the powder is propelled to an object to be cleaned by using a nozzle, back pressure occurs in a piping mounted with a nozzle. As a result the powder may be prevented from being supplied due to the counter current caused by the back pressure. Therefore, as a cleaning agent quantitative feeder described above, a feeder disclosed in Japanese patent application No. 2003-77337 may be used in which the power is ground by a scratching fin rotating in a storage tank, delivered to a measuring tank, and filled into a measuring hole of a perforated plate rotating at the bottom part of the measuring tank, so that a level amount of powder controlled by a level plate can be supplied. As a result, even when lumps are contained in the powder, it can be delivered to the measuring tank while being crushed, so that a predetermined amount of powder is supplied continuously from a supply port. This apparatus is effective when dry ice is used as the powder to be supplied.

Figure 4:
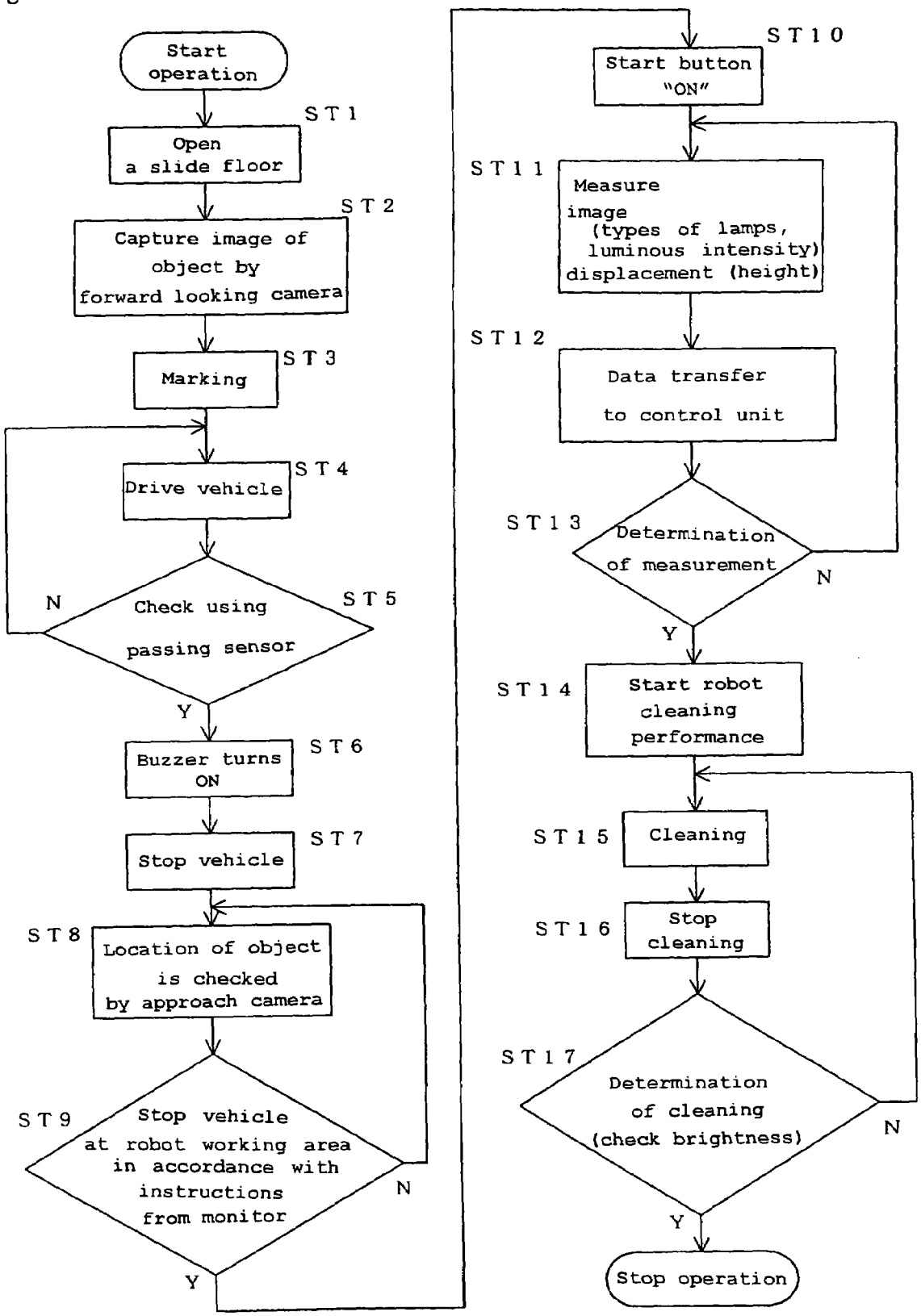
FIG. 4 is a flowchart of the cleaning operation.

FIG. 4 is a flow chart when a glass surface is cleaned by a system of the invention. A slide floor is open (step ST1), an object is captured in an image of a forward looking camera (step ST2), and it is marked with a cursor on the image (step ST3). Then, a truck is driven toward an object to be cleaned 30 (step ST4), which is checked by a passing sensor (step ST5). When the alignment check of the object produces a "NO" result, the process returns to step ST4 and the truck is again driven toward the object to be cleaned. When the alignment check of the object produces a "YES" result, a buzzer turns ON (step ST6), the truck stops (step ST7), the location of the object is checked by an approach camera (step ST8), and an initialization is instructed to an automatic cleaning system which triggers a manipulator to move and stop at a predetermined position within a robot working area (step ST9).

Those and the following operations are performed by instructions generated by the on-vehicle computer (not shown in the drawings) based on signals from various sensors.

When the check result is "NO" at step ST9, the process returns to step ST8. After "Yes" is confirmed at step ST9, a start button is turned on by an operator (step ST10), dimension, displacement, and a shape of, for example, a surface light are measured (step ST11), data transfer to a control unit (step ST12), and measurement is determined (step ST13). When the result of step ST13 is "NO", the process returns to step 11. When the result of the determination of the measurement is "OK", the steps of starting robot cleaning motion (step ST14), cleaning (step ST15), stopping cleaning (step ST16), and determining cleaning by brightness check (step ST17) are performed, and the confirmation of "OK" at step ST17 completes the cleaning operations. When the result of step ST17 is "NO", the process returns to step ST14. Thereafter, the truck moves and repeats steps from ST1 to ST17 so as to clean a number of objects in a certain area. Then, the manipulator of the robot is returned to the original position, and the slide floor is closed.

As explained above, in order to perform blast cleaning, a truck 1 is mounted with various equipment, including a compressor (compressed air supply unit) 11 and a working robot 21, a driver's cab 5 is operable to open a slide floor 6, an object is captured with a forward looking camera image displayed on a monitor 10 in the driver's cab 5 and is marked so that the truck slowly moves to a predetermined place where a surface light or a reflector 30 is located in accordance with an image or voice guide, and stops. Next, by an operator's pushing a button, an automatic cleaning system is operable to move a manipulator to a predetermined position and to stop it, an automatic confirmation system is operable to measure dimension, confirmation of the shape, and detection of the position by using a CCD camera 24. Then, the automatic cleaning system operated by on-vehicle computer operates the manipulator so that a blast nozzle 23 approaches a surface light or a reflector 30 (approximately 10 cm), blasts a cleaning agent (powdered dry ice or powdered bicarbonate) to a glass surface of an object to be cleaned 30 (for example, with a pressure of approximately 0.3 MPa-0.5 MPa for 3-10 seconds for each spot).

In other words, a blast nozzle 23, a distance sensor, and a CCD camera are mounted in the vicinity of the tip of an articulated arm freely movable in three dimensional space so that while the distance sensor detects the distance of a target object on an X-Y axis, an automatic confirmation system searches and determines the type of the target by its position, dimension, and shape. Once this step is completed, an automatic cleaning system operable to drive control a manipulator 22 operates the blast nozzle 23 to approach in the direction of Z axis while keeping a predetermined distance and cleans a surface light or a reflector 30 by blasting a cleaning agent from the blast nozzle 23. Thereafter, determination of cleaning is made as to whether or not cleaning is completed by measuring the brightness of the surface light or reflector. During these processes, automatic operation is performed by simply initiating a start button. Even for a large number of surface lights or reflectors 30, mobile cleaning can be done subsequently in a short amount of time. When a cleaning process is completed for such a large number of objects 30, a robot 21 is retracted to the load bed, and a slide floor 6 is closed.

In this invention, as defined in claims 6 and 7, a luminosity (candela) sensor may be arranged with a CCD camera so that a luminous intensity can be measured directly. The thus measured luminous intensity is compared with luminosity data stored as a recognized type of the object, which is, then, used as a determination criterion for degree of cleanliness after cleaning. In addition, when cleaning is completed or cleaning is not required, a measured luminosity value before cleaning may be stored for each object, so that the thus obtained data can be used as control data for a surface light, a runway guide light or a reflector by airport facilities.

At an airport, conventionally, a cleaning vehicle performs only cleaning (a frequency is, for instance, every single day), and a luminosity measuring vehicle is driven separately for measuring luminous intensity of an object (a frequency is, for instance, every 10 days), and luminous intensity is measured for each object to be controlled. In this invention, since a cleaning vehicle is equipped with luminosity measuring function and memory function for each object, a luminosity measuring vehicle with a single function will no longer be necessary.

As explained above, according to a system for cleaning a glass surface of a surface light, a runway guide light, or a reflector of the invention, a compressed air supply unit, a cleaning agent powder tank, an ejector for suctioning and blending a cleaning agent by high pressure air, a working robot including a manipulator mounted with a blast nozzle connected to one end of a rubber hose introduced from the ejector and a CCD camera at its end, and a monitor are mounted on a vehicle, so that the truck mounted with such an equipment stops at a working location in the vicinity of an object, that is, a surface light or a road reflector, the working robot is operated by a remote controller, the CCD camera recognize dimension and shape of an object, and a blast nozzle mounted on the tip of the manipulator approaches to the target object to blast a cleaning agent while detecting the position by the CCD camera.

Image recognition comprises a step of determining a type of an object from its shape, and recognizing the direction having a higher brightness of transmitted light and reflected light to distinguish a target object, such that while a target object is distinguished, the brightness is converted into the number of picture elements on a screen as luminosity (candela) to recognize its intensity. Furthermore, through thus stored object type information, a step may follow converting luminosity information when not polluted into the number of picture elements and comparing the both data. In addition, an ID tag (not shown in a drawing) may be equipped within a light housing, and an ID tag information reader may be mounted on the tip of this working robot arm so as to monitor/record the history of a light source lamp.

Using a soft blast system of this invention comprising the aforementioned main equipments, an experiment was carried out to examine the effect of removing and cleaning foreign materials adhered to a light. As a result, important data, which greatly affects a removal effect of accretion, i.e. particle diameter of abrasives (dry ice or bicarbonate), mixing ratio of abrasives and air, and atomizing pressure, was obtained. In the meantime, air from an air compressor was blended with abrasives and propelled at an object to clean its surface so as to measure operating time. The operating time for driving a truck to completing cleaning was between 55 and 62 seconds.

According to this invention, with a cleaning agent blaster, a working robot and a monitor mounted on a truck, the working robot is operable to move or lower a blast nozzle to a target object, i.e. a surface light or a road reflector, so as to clean the glass surface of the surface light or the reflector by blasting a cleaning agent. As a result, it can prevent the object from being scratched, and does not elevate environmental loading. In addition, as the injection pressure is low, an object can be cleaned safely and easily while saving energy.

Explanation of Reference Numerals

1 truck
2 load bed
2*a* canopy
3 base
4 wheel
5 driver's cab
6 opening cover panel (slide floor)
7 generator
8 operating unit
8*a* truck-driving indicating apparatus
8*b* cleaning start/stop button
9*a* forward looking camera
9*b* passing sensor
10 monitor
11 compressor
12 dryer
13 filter
14 blow tank
15 air delivery valve
16 ejector
17 cleaning agent supply controller
18 cleaning agent tank
19 cleaning agent quantitative feeder
20 high pressure rubber hose
21 working robot
22 manipulator
23 blast nozzle
24 CCD camera
24*a* distance sensor
25 robot controller
26 bracket
27 approach camera
30 cleaned object (surface light, reflector)

What is claimed is:

1. A system for cleaning a glass surface of a surface light or a reflector comprising a truck mounted with a cleaning agent blaster, an articulated working robot including a blast nozzle and a CCD camera mounted on a front end of a manipulator, and an operating unit including an on-vehicle computer operable for recognizing dimensions from positional information based on an image of the cleaned object taken by the CCD camera and for collating the image shame of the object with a stored share so as to calculate positional information of the object, wherein an opening floor part which is freely open-close is provided in the vicinity of the center or the rear part of a load bed of the truck for lowering the blast nozzle mounted on the front end of the manipulator toward the object located on the ground and under the load bed in connection with instructions from the on-vehicle computer;

and wherein a monitor displaying an image taken by the CCD camera for monitoring a cleaned object and a start/stop button for cleaning operation are provided near the driver's seat;

so that after the blast nozzle is lowered, a cleaning agent is blasted from the blast nozzle mounted on the front end of the manipulator of the working robot toward the target object while measuring and determining the extent of cleaning based on brightness or light intensity of the cleaned object from an image taken by the CCD camera to perform and complete automatic cleaning, further comprising an extensible cornice for preventing dissipation of abrasives provided in such a manner to hang under the periphery of an opening floor part of the load bed of a truck so that the abrasive and its volatilized gas produced after cleaning do not leak outside, wherein the opening floor part is closed and the cornice is folded after cleaning so that the abrasive and its volatilized gas are sealed within an isolated room in a canopy on the load bed of the truck mounted with a working robot.

2. A system for cleaning a glass surface of a surface light or a reflector comprising a truck mounted with a cleaning agent blaster, an articulated working robot including a blast nozzle and a CCD camera mounted on a front end of a manipulator, and an operating unit including an on-vehicle computer operable for recognizing dimensions from positional information based on an image of the cleaned object taken by the CCD camera and for collating the image shape of the object with a stored shape so as to calculate positional information of the object, wherein an opening floor part which is freely open-close is provided in the vicinity of the center or the rear part of a load bed of the truck for lowering the blast nozzle mounted on the front end of the manipulator toward the object located on the ground and under the load bed in connection with instructions from the on-vehicle computer;

and wherein a monitor displaying an image taken by the CCD camera for monitoring a cleaned object and a start/stop button for cleaning operation are provided near the driver's seat;

so that after the blast nozzle is lowered, a cleaning agent is blasted from the blast nozzle mounted on the front end of the manipulator of the working robot toward the target object while measuring and determining the extent of cleaning based on brightness or light intensity of the cleaned object from an image taken by the CCD camera to perform and complete automatic cleaning, and wherein transmittancy or luminous intensity of an object is measured after cleaning to determine if re-cleaning is required or cleaning is completed.

3. A system for cleaning a glass surface of a surface light or a reflector defined in claim 2 further comprising a driver's aid for directional guidance that is capable of operating a truck to capture an object to be cleaned at a predetermined position from an image taken by a forward looking CCD camera mounted under the truck, capable of moving the forward looking CCD camera while automatically capturing the object image, and capable of instructing driving speed and direction of the truck depending on its operation stage.

4. A system for cleaning a glass surface of a surface light or a reflector defined in claim 2, wherein driving instruction is given by using an image taken by an approach camera provided at the position where an image beneath an opening floor part can be taken, wherein the image can be used as start-up information for the automatic cleaning system which operates on a manipulator.

5. A system for cleaning a glass surface of a surface light or a reflector comprising a truck mounted with a cleaning agent blaster, an articulated working robot including a blast nozzle and a CCD camera mounted on a front end of a manipulator, and an operating unit including an on-vehicle computer operable for recognizing dimensions from positional information based on an image of the cleaned object taken by the CCD camera and for collating the image shape of the object with a stored shape so as to calculate positional information of the object, wherein an opening floor part which is freely open-close is provided in the vicinity of the center or the rear part of a load bed of the truck for lowering the blast nozzle mounted on the front end of the manipulator toward the object located on the ground and under the load bed in connection with instructions from the on-vehicle computer;

and wherein a monitor displaying an image taken by the CCD camera for monitoring a cleaned object and a start/stop button for cleaning operation are provided near the driver's seat;

so that after the blast nozzle is lowered, a cleaning agent is blasted from the blast nozzle mounted on the front end of the manipulator of the working robot toward the target object while measuring and determining the extent of cleaning based on brightness or light intensity of the cleaned object from an image taken by the CCD camera to perform, and complete automatic cleaning, and wherein transmittancy or luminous intensity of an object is stored when the determination of the completion of the cleaning is made, so that the information is used to manage the light of the object.

6. A method for blast-cleaning an object embedded in the ground having a predetermined interval between each other and having a glass surface on its top surface, comprising the steps of:

providing a truck with a canopy mounted with a cleaning agent blaster, an articulated working robot provided with a blast nozzle, a distance sensor, and a CCD camera at a front end of a manipulator, an approach camera and a passing sensor for recognizing if an object exists within coverage of the articulated working robot, and an operation unit including on-vehicle computer which is operable to recognize dimensions and shape of the object from the measuring data based on an image and distance of an object obtained by the CCD camera and the distance sensor in such a manner to collate the thus obtained data with a stored shape, and then operable to process the information of the glass surface of the object to be cleaned;

providing a monitor displaying an image taken by the approach camera or the CCD camera for monitoring a cleaned object and a start/stop button for starting/stopping automated cleaning operation of the articulated working robot near the driver's seat of the truck;

providing an opening floor part which is freely open-close in the vicinity of the center or the rear part of a load bed of the truck wherein the approach camera and the passing sensor are mounted on its circumference for stopping the truck when capturing an image of an object through the monitor within their lower photographed area; and automatically cleaning a glass surface of an object to clean by steps of stopping the truck at a position where the object exists within the photographed area beneath the open-close-free opening floor part, automatically operating the articulated working robot by pressing the start button manually, approaching the blast nozzle toward the position of the glass surface of the object calculated by the on-vehicle computer, and blasting a cleaning agent from the blast nozzle while measuring and determining the extent of cleaning based on brightness or light intensity of the object cleaned from an image taken by the CCD camera.

7. A system for blast-cleaning an object embedded in the ground having a predetermined interval between each other and having a glass surface on its top surface, comprising:

a truck having a canopy mounted with a cleaning agent blaster, an articulated working robot provided with a blast nozzle, a distance sensor, and a CCD camera at a front end of a manipulator, an approach camera and a passing sensor for recognizing if an object exists within coverage of the articulated working robot and an operation unit including on-vehicle computer which is operable to recognize dimensions and shape of the object from the measuring data based on an image and distance of an object obtained by the CCD camera and the distance sensor in such a manner to collate the thus obtained data with a stored shape, and,then operable to process the information of the glass surface of the object to be cleaned;

a monitor displaying an image taken by the approach camera or the CCD camera for monitoring a cleaned object and a start/stop button for starting/stopping automated cleaning operation of the articulated working robot provided near the driver's seat of the truck; and an opening floor part which is freely open-close provided in the vicinity of the center or the rear part of a load bed of the truck wherein the approach camera and the passing sensor are mounted on its circumference for stopping the truck when capturing an image of an object through the monitor within their tower photographed area;

wherein after stopping the truck at a position where the object exists within the photographed area beneath the open-close-free opening floor part, the articulated working robot is automatically operated by pressing the start button manually so as to approach the blast nozzle toward the position of the glass surface of the object calculated by the on-vehicle, and to blast a cleaning agent from the blast nozzle while measuring and determining the extent of cleaning based on brightness or light intensity of the object cleaned from an image taken by the CCD camera to perform automatic cleaning of the glass surface of the object.

8. A system defined in claim 7, wherein the object to be cleaned is a glass surface of a surface light, a runway light or a reflection mirror and the cleaning agent is powder type bicarbonate or dry ice.

9. A system defined in claim 7, further comprising a driver's aid for directional guidance that is capable of operating a truck to capture an object to be cleaned at a predetermined position from an image taken by a forward looking CCD camera mounted under the truck by marking a screen with a cursor, capable of moving the forward looking CCD camera automatically while capturing the object image and capable of instructing driving speed and direction of the truck depending on its operation stage.

10. A system for blast-cleaning an object embedded in the ground having a predetermined interval between each other and having a glass surface on its top surface comprising:

a truck having a canopy mounted with a cleaning agent blaster, an articulated working robot provided with a blast nozzle, a distance sensor, and a CCD camera at a front end of a manipulator, an approach camera and a passing sensor for recognizing if an object exists within coverage of the articulated working robot, and an operation unit including on-vehicle computer which is operable to recognize dimensions and shape of the object from the measuring data based on an image and a distance of an object obtained by the CCD camera and the distance sensor in such a manner to collate the thus obtained data with a stored shape, and then operable to process the information of the glass surface of the object to be cleaned;

a monitor displaying an image taken by the approach camera or the CCD camera for monitoring a cleaned object and a start/stop button for starting/stopping automated cleaning operation of the articulated working robot provided near the driver's seat of the truck; and an opening floor part which is freely open-close provided in the vicinity of the center or the rear part of a load bed of the truck wherein the approach camera and the passing sensor are mounted on its circumference for stopping the truck when capturing an image of an object through the monitor within their lower photographed area;

wherein an extensible cornice for preventing dissipation of abrasives provided in such a manner to hang under the periphery of an opening floor pint of the load bed of a truck so that the abrasive and its volatilized gas produced after cleaning do not leak outside, wherein the opening floor part is closed and the cornice is folded after cleaning so that the abrasive and its volatilized gas are sealed within an isolated room in a canopy on the load bed of the truck mounted with the articulated working robot.

11. A system defined in claims 7 or 10, wherein driving instructions is given by using an image taken by an approach camera provided at the position where an image beneath an opening floor part can be taken, wherein the image can be used as star-up information for the automatic cleaning system which is operated by a manipulator.

12. A system defined in claims 7 or 10, wherein transmittancy or luminous intensity of an object is measured after cleaning to determine if re-cleaning is required or cleaning is completed.

13. A system defined in claims 7 or 10, wherein transmittancy or luminous intensity of an object is stored when the determination of the completion of the cleaning is made, so that the information is used to manage the light of the object.

* * * * *